United States Patent [19]

Meshberg

[11] 4,311,255

[45] Jan. 19, 1982

[54] HAND HELD CONTAINER AND DISPENSER ASSEMBLY

[76] Inventor: Philip Meshberg, 2500 S. Ocean Blvd., Bldg. 3, Apt. 1-A, Palm Beach, Fla. 33480

[21] Appl. No.: 89,394

[22] Filed: Oct. 30, 1979

[51] Int. Cl.[3] ..... B05B 11/00

[52] U.S. Cl. ..... 222/183; 222/321; 215/1 C; 215/205; 220/8

[58] Field of Search ..... 222/321, 383, 183; 220/8; 215/1 C, 205, 1 R

[56] References Cited

U.S. PATENT DOCUMENTS

| | | | |
|---|---|---|---|
| 2,521,278 | 9/1950 | Bauman | 220/8 |
| 2,617,699 | 11/1952 | Sullivan | 220/8 X |
| 3,024,936 | 3/1962 | Logue | 220/8 X |
| 3,285,461 | 11/1966 | Santelli | 215/1 C |
| 4,022,354 | 5/1977 | Kotuby | 222/321 |
| 4,025,046 | 5/1977 | Boris | 222/321 X |
| 4,061,247 | 12/1977 | Meshberg | 222/321 X |

FOREIGN PATENT DOCUMENTS

| | | | |
|---|---|---|---|
| 2817061 | 10/1979 | Fed. Rep. of Germany | 220/8 |

*Primary Examiner*—Robert J. Spar
*Assistant Examiner*—Frederick R. Handren
*Attorney, Agent, or Firm*—Kenyon & Kenyon

[57] ABSTRACT

A dispenser package has an outer case which is open on one end and which receives, in its other, partially closed, end, a snap-fitted dispenser assembly. The actuating stem of the dispenser extends out of a small opening in the end of the outer case to which the dispenser is fitted. A closely fitted inner container is filled with the fluid product to be dispensed and is then press fitted into the outer case, provision being made to vent the trapped air during assembly. The inner end of the inner case is seated against the dispenser assembly and so provides additional direct support for maintaining the dispenser in place.

9 Claims, 4 Drawing Figures

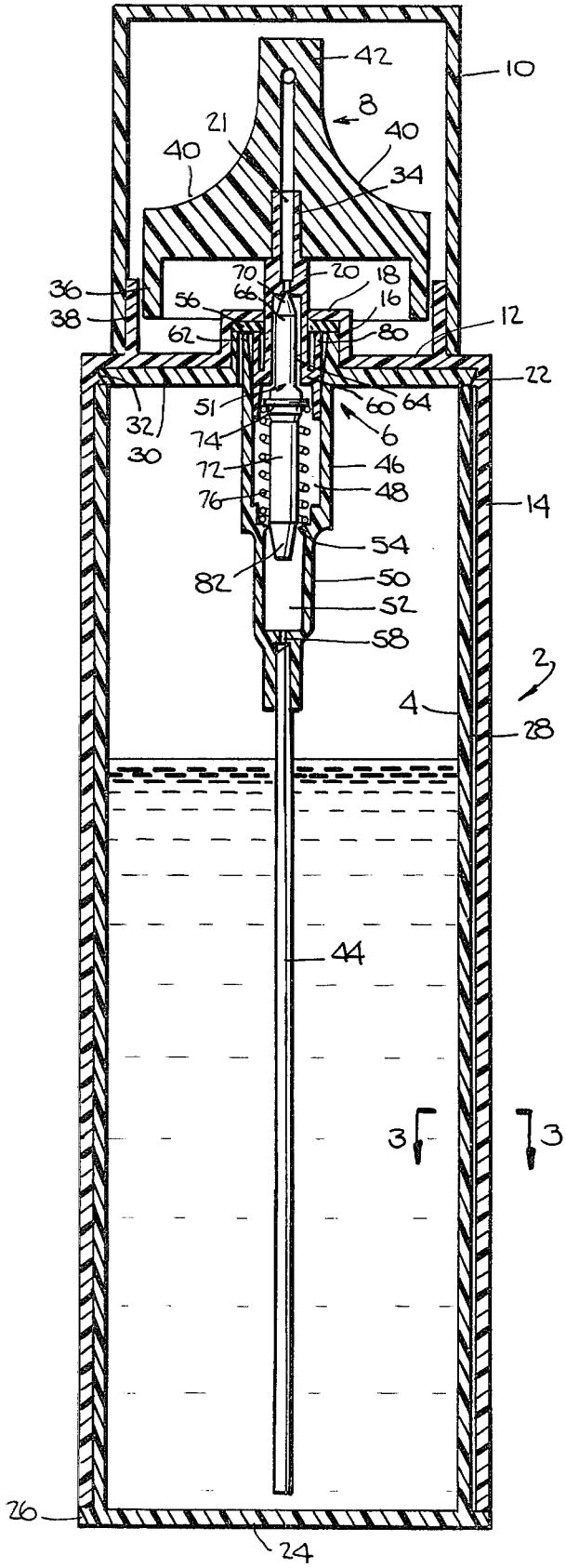
Fig. 1.
Fig. 2.
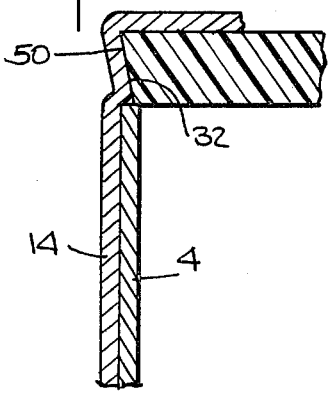
Fig. 3.
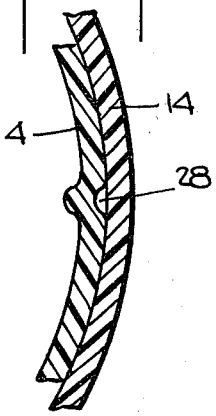
Fig. 4.
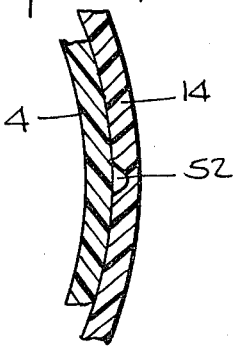

HAND HELD CONTAINER AND DISPENSER ASSEMBLY

BACKGROUND OF THE INVENTION

1. Field of the Invention

This invention relates to hand-contained dispensing packages for use in dispensing fluids and the like. More particularly, it relates to a two part container for holding the fluid to be dispensed, one part of which has a finger actuated dispenser assembled to it, prior to assembly, and the other part of which contains the fluid to be dispensed.

2. Discussion of the Prior Art

It is known in the cosmetic industry to attach an atomizing dispenser to a bottle or can by means of a threaded connection between a cap which holds the pump on the bottle so that a user, by means of finger pressure applied to the end of the dispenser, can pump a stream or spray of fluid from the contents of the container. Such dispensers may also be attached to a container by means of a flange crimped around the bead which forms the lip of the container, as is shown in U.S. Pat. No. 4,113,145, issued to Philip Meshberg, and entitled DISPENSING UNIT FOR LIQUID AND METHOD OF DISPENSING.

Conventionally, hand-held packages using finger-activated mechanical dispensers are assembled by attaching the dispenser to bottles or cans by means of screw caps or ferrules which are fastened to the neck of the container. In many situations, however, the cost of appropriately decorative containers of blown glass or of metal results in an expensive product. This is partly because the containers themselves represent a substantial cost. It would therefore be desirable to use plastic containers which can be injection molded at low cost and which present a wide range of decorative choice to the package designer, if a reliable, convenient, and inexpensive way of attaching the dispensers to suitable containers were available.

The high cost of packaging also results, in part, because, in most types of one piece container, the dispenser must be attached after the container has been filled; or, in those packages in which the dispenser is put in place before filling, the filling must be done slowly through restrictive passages in the pump structure. It is an object of the invention, therefore, to provide for assembly of the dispenser to a part of the container before filling, while avoiding the need to fill the container through the dispenser and which, at the same time, eliminates the mounting cup by which dispensers are usually fastened to the containers.

It is also an object of this invention to provide a new and novel container assembly for use with a hand activated, mechanical dispenser which is less expensive to fabricate, while being susceptible to a wide variety of inexpensive exterior decoration. The container assembly can be provided in a variety of shapes and in a variety of materials and is capable of a variety of appearances, beginning with that provided by a wide choice of materials and colorings.

It is another object of the invention to provide a container having an interior which is internally compatible with the material to be dispensed.

Finally, it is an object of the invention to reduce the cost of a two piece container below that of a conventional glass or extruded metal container.

SUMMARY OF THE INVENTION

The above objects and others which will become clear upon reading the following detailed description of the invention are met in a container having an outer case which is open on one end and which receives, in its other, partially closed, end, a snap-fitted dispenser assembly. The actuating stem of the dispenser extends out of a small opening in the end of the outer case to which the dispenser is fitted. A closely fitted inner container is filled with the fluid product to be dispensed and is then press fitted into the outer case, provision being made to vent the trapped air during assembly. The inner end of the inner case is seated against the dispenser assembly and so provides additional direct support for maintaining the dispenser in place.

BRIEF DESCRIPTION OF THE DRAWINGS

FIG. 1 is a view, in cross-section, of a nasal spray dispensing package embodying the teachings of the invention;

FIG. 2 is an enlarged view, in cross-section, of an alternative snap-fit structure for use in a container according to the invention;

FIG. 3 is a partial view, in cross-section, of a portion of the structure of FIG. 1, showing one construction of the vent; and FIG. 4 is a view of an alternate vent structure to that shown in FIG. 3.

DETAILED DESCRIPTION OF THE INVENTION

Reference is now made to FIG. 1 which shows a spray dispenser having a container assembly produced in accordance with the teachings of the invention. The container includes an outer case 2, an inner case 4, a dispenser assembly 6, a vertical actuator 8, and a cover 10.

Outer case 2 is shown as cylindrical in the illustrative embodiment; it will be understood that it could also be some other shape, such as oval or square, in cross-section. Outer case 2 is provided, at one end, with a transverse wall 12 which extends inward from outer wall 14 towards the axis of case 2, and is further provided with a projecting cup portion 16 whose end wall 18 contains a central aperture for passage of a projecting drive cylinder 20 of dispenser 6. The inner part of wall 14 is provided, next to end wall 12, with a ledge or shoulder 22 whose inner surface is not cylindrical, but rather, is tapered to form, in effect, a truncated cone which has its larger diameter adjacent to case end 12. As will be seen, this inner beveled step 22 serves as a convenient fitting into which an appropriately beveled, laterally projecting portion of dispenser 6 can be snap fitted. The step need not be fully circumferential, but may be formed in segments, spaced around the circumference.

Inner case 4 is slightly smaller in diameter than outer case 2, being designed to fit closely inside of it in a press fit, in a manner well known in the art. Inner case 4 is open at the inner end, being closed at the outer end by means of bottom wall 24. There is a laterally projecting flange portion 26 integrally formed on the bottom outside surface of case 4 against which the end of outer wall 14 of container 2 abuts when the two case parts are assembled. As may be seen in FIG. 3, the outside surface of the wall of inner case 4 is provided with a longitudinal groove 28 which runs the length of the wall and which serves to vent entrapped air during assembly of the cases. The ends of vent groove 28 are closed off by shelf 22 and by flange 26 when assembly is complete.

Dispenser 6 may be of any type well known in the art. In the illustrated embodiment, dispenser 6 is an atomizing pump dispenser. Dispenser 6 is provided with an integrally formed, radially projecting flange 30, and has its activating stem 20 projecting through end wall 18 of outer case 2. The circumferential surface 32 of flange 30 is slightly tapered, having its narrower diameter nearest to the container space, so as to provide a mating fit with a likewise tapered, mating surface 22 of outer case 2. Its larger diameter is chosen so that, when pressed into place in case 2 during assembly, a snap fit results between the shoulder 22 and flange 30, which locks dispenser 6 in place in end wall 6 of case 2.

In the illustrated embodiment, the principles of the invention are shown as applied to a nasal spray. Thus a stub 34, projecting axially from actuating stem 20, is fastened in a mating recess of vertical actuator 8 through which a passageway 21 is provided for delivery of material being dispensed. Vertical actuator 8 has a dependent skirt 36 which is received in a recess between projecting end cup 16 of case 2 and concentric cylindrical case extension 38; the latter is close fitted to skirt 36 and serves as a guide for actuator 8. The outer surface of projecting cylindrical extension 38 receives container cover 10 which is slip fitted thereto in a manner well known in the art.

To facilitate use of the dispenser as a nasal spray, opposite sides of the end of vertical actuator 8 are cut away to provide recesses 40. The projecting tip 42 thus formed between recesses 40 may conveniently be slipped between two fingers of one hand, which are fitted into the recesses. By applying pressure from the thumb of the same hand on the bottom 24 of case 2, the dispenser may be operated by one hand. A dispenser of this type may be made small enough to be conveniently carried in a purse.

Dispenser assembly 6 is also provided with a dependent tube 44 which extends to a point near the bottom of inner case 4 for gathering material to be pumped out of the container.

It is to be noted that the combination of the tapered peripheral surface 32 on dispenser flange 30 with the tapered inner surface 22 on the inner surface of outer case 14 provides an effective snap fit for retaining the dispenser in position in the case. It is an additional feature of the invention that support is also derived from the inner end of inner case 4. To this end, the small shoulder 22 on the inner surface of case 2 and the thickness of the wall of inner case 4 are so proportioned that the flat surface of shoulder 22 serves as a stop for the open end of inner case 4. At the same time, the thickness of the wall of inner case 4 is made greater than the radial height of shoulder 22 so that the end surface of case 4 presses against the bottom surface of pump flange 30. In this way support and sealing of the dispenser are achieved. In some instances it may be necessary to place a gasket or other type of seal between the upper surface of flange 32 and end wall 12 of outer case 2 in order to prevent escape of contained liquid.

The structure of dispenser 6 is disclosed in U.S. patent application, Ser. No. 682,059, which was abandoned in favor of U.S. patent application Ser. No. 765,701, filed Feb. 2, 1977. It has an upper pump body section 46 forming a first chamber 48 and a lower pump body section 50 forming a second chamber 52 which is connected to the first chamber via a throat 54. The upper pump body section is integrally formed with flange 30 and abuts against a disk 56, which can be of rubber or other flexible material, when the pump is snapped into place in outer case 2. A plurality of notches or passageways 62 are formed at the top of upper body section 46 to provide venting. Dependent gathering tube 44 communicates with lower pump chamber 52 via axial bore 58.

Within upper chamber 48 is located a piston 60 which is on the end of projecting stem 20. Stem 20 is provided with upper cylindrical portion 34 upon which actuator and nozzle 42 are seated. Axial bore 21 is formed in the upper portion 34 of stem 20 and communicates with a second axial bore 64 formed in the lower portion of the stem and extending within the confines of piston 60. Disposed within bore 64 is a valve member 51 having a cylindrical upper portion 66 which terminates in an upper conical section 70 which seats in axial bore 21 to form an outlet valve for the pump. A cylindrical portion 72 is integrally molded on the lower portion of valve member 51, which is of greater diameter than upper portion 66. There is a flange 74 between upper portion 66 and lower portion 72 of valve member 51. A spring 76 is placed between the bottom of chamber 48 and the lower surface of flange 74 to bias the valve member upward and push conical section 70 into sealing contact with the lower edge of axial bore 21, sealing it off, and to push stem 20 and piston 60 upward. Stem 20 has a friction-tight fit where it passes through sealing disk 66 which, along with upper flange 80 of piston 60, prevents leakage of material from the pump and container when unoperated. Stem 20 is tapered and, when operated, provides venting. The diameter of stem section 68 is such that material can flow upwards along it under pressure from piston 60. The lower end 82 of lower cylindrical portion 72 is tapered near the bottom and provides communication between lower chamber 52 via throat 54 for venting purposes when the pump is unoperated. In this way communication is established between upper chamber 48, lower chamber 52, and fill tube 44.

In operation, pressure on actuator 42 moves piston 60 downward, and with it the valve member. After travelling a short distance, the full diameter of lower cylindrical portion 72 enters throat 54, closing off the bottom of chamber 48. As pressure is continued on the actuator, pressure builds up inside chamber 48 which acts on the surface of the valve member, resulting in a net force against the force of spring 76. When the pressure times the difference between the area of throat 54 and the effective axial area of the upper end 66 of valve member 51 equals and exceeds the force of spring 76, the valve member moves downward, opening the connection with axial bore 78 and permitting material to pass into actuator 42 for delivery as a spray. As the stem 20 continues downward, air is able to enter around its tapered outside surface and through passages 62 to equalize the air pressure in the container. When the stroke is completed and the stem is allowed to move upward, the uncovering of tapered section 82 allows the partial vacuum which has been created in chamber 48 to draw additional fluid up into chamber 48, readying for the next dispenser stroke.

The teachings of the invention are subject to considerable variation, as will be apparent to those skilled in the art. FIGS. 2, 3, and 4 are suggestive of changes that can be made without departing from the spirit of the invention.

In FIG. 2, the outer rim of pump flange 32 is tapered, as before. It is received on a conforming step 50 which is formed in wall 14 of an outer case 2 by rolling, for example. In this instance, container case 2 may be made of metal.

FIG. 4 provides an alternate vent structure to that of FIG. 3. In it the longitudinal groove 52 is formed on the inner surface of outer case 52.

The structure just described not only provides certain structural advantages, but it also provides particular advantage in that the materials used for pump body 6 and, more particularly, for the inner surfaces of flange structure 30 and inner case 4 may be selected for compatibility with the material to be dispensed. Thus, an appropriate metal or plastic may be chosen, depending upon the chemically reactive nature of the materials to be contained. Also, the inner container may be coated with a material which is more compatible with the material to be dispensed than the material forming the container. Or the inner container may be stainless steel while other, less expensive materials are used for other parts of the assembly. In this connection, the lower surface of flange 30 may be isolated from the contents of the container by a suitable cover surface or gasket.

At the same time, the material of outer case 2 can be chosen on the basis of cost, decorative nature, or other criterion, as can the material used for vertical actuator 8 and cover 10. Designs may thus be provided which are characterized by low cost, decorativeness, or some other marketing determinant. Also, one or both case parts can be injection molded from a plastic at a lesser cost than is incurred in blow molding a bottle or deep drawing a metal container.

Finally, it is to be noted that the pump may be preassembled to the outer case requiring only, in final assembly, that the inner case be filled on the assembly line prior to being mated with outer case 2. A simpler and, therefore, less expensive assembly is thus provided.

While the invention has been described and illustrated with respect to a dispenser on a container intended primarily for liquids, it will be apparent to those skilled in the art that the invention may be used for other dispensable products, such as a powder or some other material which is flowable or fluid. Also, it is to be understood that, while the illustrated dispensing mechanism is a pump actuated by the hand of the user, another type of dispenser may be employed, such as a valve which depends upon the presence of above atmospheric gas pressure within the space holding the material to be dispensed.

What is claimed is:

1. A dispensing package for fluids including a finger-actuated dispenser and a container, and comprising:

a tubular outer case having an open end and a closed end comprising an end wall having an aperture through which the actuator of the dispenser projects;

locking means at the closed end of the outer case for holding the dispenser in place;

a conformably fitting inner case, press-fitted into the outer case to form the container, the inner case having a closed end and an open end which is inserted into the outer case;

a passageway, located between the inner and outer case and extending the length of the outer case, for permitting air to escape from the container when the cases are press-fitted together; and at least one seating surface for closing off the passageway when the inner case is seated in the outer case.

2. The dispensing package of claim 1 in which the passageway is a longitudinal groove in the outer surface of the inner container.

3. The dispensing package of claim 1 in which the passageway is a longitudinal groove in the inner surface of the outer container.

4. A dispensing package in accordance with claim 1, in which the seating surface forms part of the closed end of the outer case against which the open end of the inner case is seated.

5. A dispensing package in accordance with claim 1, in which the seating surface is on a flange attached to and surrounding the closed end of the inner case against which the open end of the outer case is seated.

6. A dispensing package in accordance with claim 1, in which there are two seating surfaces for closing off the passageway which comprise a seating surface at the closed end of the outer case against which the open end of the inner case is seated and a surface on a flange attached to and surrounding the inner case against which the open end of the outer case is seated.

7. A dispensing package in accordance with any one of claim 5 and claim 6 in which the length of the outer case is substantially equal to the length of the inner case.

8. A dispensing package in accordance with claim 4, in which the seating surface at the closed end of the outer case is on an inward projecting shelf and the shelf has a tapered surface lying between the first surface and the end wall, the tapered surface conforming, at least in part, to the surface of a truncated cone which has its larger diameter at the end wall, and further comprising:

a mounting flange on the dispenser, the mounting flange having a tapered circumferential surface which mates with the second surface of the shelf, the tapered surface of the flange being snap-fitted into locking engagement with the tapered surface of the shelf.

9. A dispensing package in accordance with claim 8, in which the seating surface of the shelf extends radially inward a predetermined distance from the wall of the outer case and the thickness of the wall of the inner case is greater than the predetermined distance, and further comprising:

a bottom surface on the mounting flange of the dispenser, the bottom surface of the mounting flange and the seating surface of the shelf together serving as a seat for the open end of the inner case.

* * * * *